US005549532A

United States Patent [19]

Kropp

[11] Patent Number: 5,549,532

[45] Date of Patent: Aug. 27, 1996

[54] PORTABLE ELASTIC RESISTANCE EXERCISE DEVICE

[76] Inventor: Daniel P. Kropp, 6823 E. Paradise Dr., Scottsdale, Ariz. 85254

[21] Appl. No.: 389,131

[22] Filed: Feb. 14, 1995

[51] Int. Cl.[6] ..... A63B 21/04

[52] U.S. Cl. ..... 482/126; 482/122; 482/124

[58] Field of Search ..... 482/124, 125, 482/126, 121, 73, 82, 139, 106, 908, 122

[56] References Cited

U.S. PATENT DOCUMENTS

| | | | |
|---|---|---|---|
| 4,618,142 | 10/1986 | Joseph | 482/82 |
| 4,733,862 | 3/1988 | Miller | 482/126 |
| 4,756,527 | 7/1988 | Ledbetter | 482/139 |
| 4,779,867 | 10/1988 | Hinds | 482/126 |
| 4,796,881 | 1/1989 | Watterson | 482/73 |
| 4,909,505 | 3/1990 | Tee | 482/121 |

*Primary Examiner*—Stephen R. Crow
*Attorney, Agent, or Firm*—Richard R. Mybeck; Peter B. Scull

[57] ABSTRACT

An elastic resistance exercise device is described which comprises an elongated elastic member having a handle attached at each end by friction-lock components. A disassemblable bar member is used coactively with the elastic member or with the handles by sliding the bar in and through hollow cylinders operatively attached to the handles. The handles provide adjustable detachability of the elastic member by the coaction of receptacles defined therein through which the elastic member is slidably fit and frictionally retained. In one handle, a solid plug is frictionally inserted in the elastic member and at the other handle, an adjustable member attached to a pull handle frictionally bears upon the elastic member and secures it in the handle. The device can be assembled into a small compact mass to facilitate transport in a briefcase or the like when traveling.

19 Claims, 2 Drawing Sheets

PORTABLE ELASTIC RESISTANCE EXERCISE DEVICE

The present invention relates generally to exercise devices and more particularly to a portable exercise device especially adapted to accompany the frequent traveler and provide a complete inventory of fitness exercises wherever there is a chair and a door.

BACKGROUND OF THE INVENTION

The need for keeping the human body fit and in good physical condition is well known, and for this reason, fitness and health clubs, with their wide assortments of weight training and other exercise equipment, have become popular places. However, what has not been adequately addressed are means to maintain one's hard earned good physical condition when one is required to frequently travel and can not visit his/her regular health club or gym. Moreover, the vast majority of persons do not even avail themselves of the benefits of regular workouts, whether at health clubs or otherwise. Thus, a tremendous need exists for providing simple, lightweight, compact portable exercise devices that are adaptable for use in training a large variety of human muscle groups.

Devices to aid in the exercise of various muscle groups have been manufactured for many years. The use of a bar with an elastic cord to simulate weight lifting was described as early as 1912 in U.S. Pat. No. 1,019,861. More recent attempts employing a bar and/or an elastic cord member, either separately or together, to facilitate exercise are described in U.S. Pat. Nos. 4,059,265 (1977), 4,733,862 (1988) and 5,029,847 (1991). Each of these devices provides means for exercising select muscle groups and some are relatively compact. However, none of the prior art devices provide a single, fully reducible, compact exercise device that is adaptable for exercising and training a full complement of human muscle groups. It is toward this desideratum that the present invention is directed.

BRIEF SUMMARY OF THE INVENTION

The present invention relates generally to a portable elastic resistance exercise device and more particularly to a novel and unique readily transportable device comprising a disassemblable bar, a pair of hand grips operatively associated with the bar and interconnectable to each other by an elastic member, and means for operatively connecting the device to conveniently located doors and/or furniture to anchor the device for certain exercises. A plurality of interchangeable elastic members of various elastic strengths are provided to vary the resistance presented to the user.

At least one hand grip is preferably fitted with an adjustable cork-shaped member to allow the length of the elastic member to be adjusted to optimize the device for use in different exercises or for different sized people.

A primary object of the present invention is to provide a portable exercise device that simulates free weight training, permitting exercising and training of major muscle groups in the human body and which can be utilized wherever there is a door and/or chair.

Another object of the present invention is to provide an exercise device which is easy to assemble, disassemble and store and yet is small enough to fit within a business briefcase.

A further object of the present invention is to provide an elastic resistance exercise device that has a simple adjustment means for accommodating different exercises and user sizes.

Still another object of the present invention to provide an elastic resistance exercise device having adjustment means for the length of the elastic member which precludes unexpected release of that member during exercise.

These and still further objects, as shall hereinafter appear, are readily fulfilled by the present invention in a remarkably unexpected fashion as will be readily discerned from the following detailed description of an exemplary embodiment thereof especially when read in conjunction with the accompanying drawings in which like parts bear like numerals throughout the several views.

DESCRIPTION OF THE PREFERRED EMBODIMENT

Figure 1:
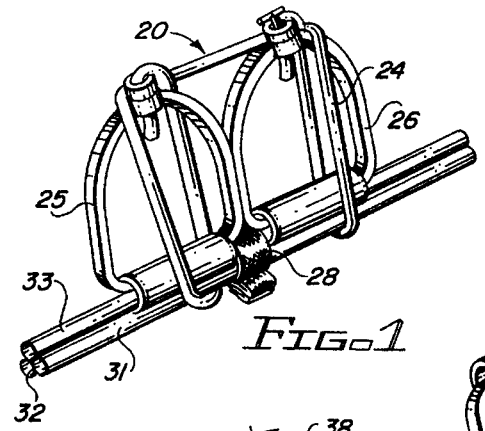
FIG. 1 is an isometric view of a portable elastic resistance exercise device embodying the present invention when the several component parts are assembled for storage or transport.

The present invention relates to an elastic resistance exercise device which, as shown in the attached FIGS., is identified by the general reference numeral 20. In FIG. 1, all of the component members of exercise device 20 are assembled into and securely interlocked to define a compact unit suitable for storage or transport. Unitary device 20, when thus assembled, is compact enough to be easily carried by hand or transported in a compact carrying case such as an ordinary briefcase.

Figure 2:
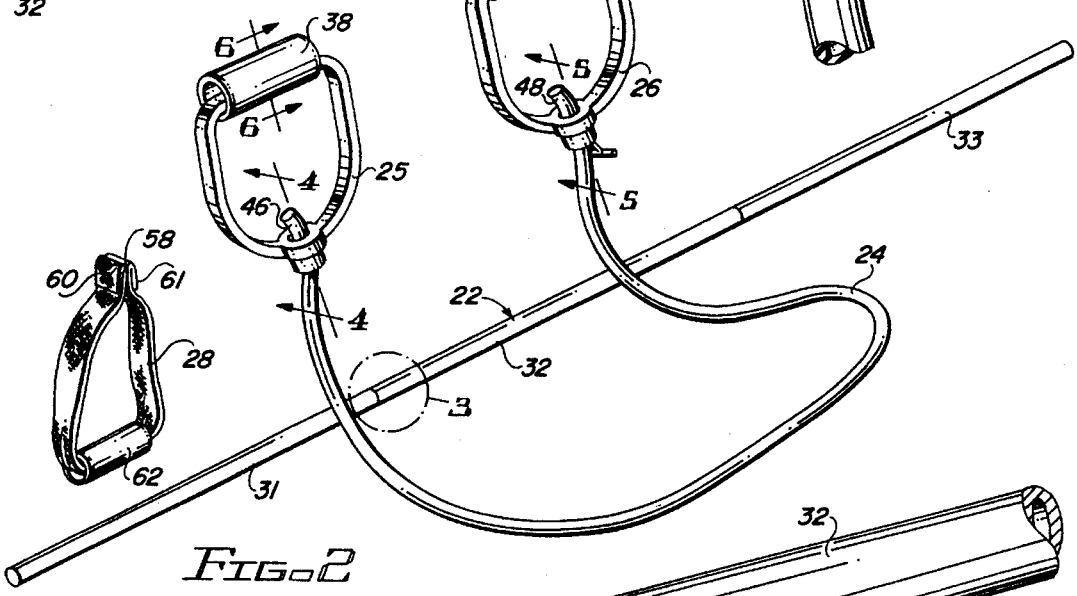
FIG. 2 is an isometric view of the exercise device of the present invention showing the several component parts.

FIG. 2 shows the compact device 20 of FIG. 1 in an exploded view for convenience of description. Device 20 generally comprises a bar member 22, and an elastic tubing member 24 which is adjustably and detachably attached to and extends between a first handle means 25 and a second handle means 26. Anchor member 28 is yet another component of device 20 which will be described further below.

Figure 3:
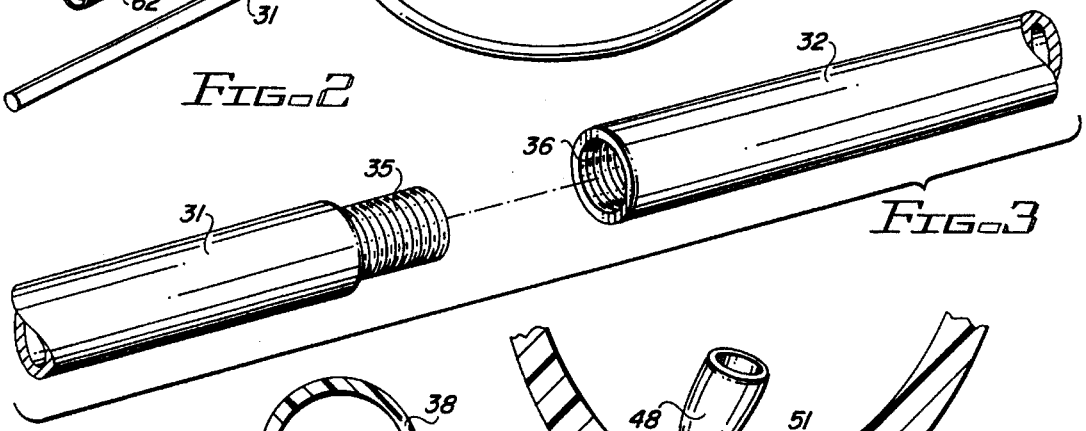
FIG. 3 is an exploded isometric view of the area marked "3" in FIG. 2 showing a threaded coupling for connecting adjacent sections of the bar member in accordance with the present invention.

In the preferred embodiment, bar member 22 comprises three component parts or sections 31, 32 and 33 which are axially joinable to form bar member 22 as shown in FIGS. 2 and 3. Section 32 is provided with an internally threaded female socket 36 at each end thereof. As shown in FIG. 3, one socket 36 is adapted to receive and secure therein the externally threaded male end 35 of section 31. Section 33 is provided with a like threaded male end (not shown) for threaded engagement within the other threaded socket (also not shown) of section 32. The remote ends of sections 31 and 33 are smooth, non-threaded surfaces. Note, other known means of connecting sections 31, 32 and 33 into a single bar member 22 may be employed and yet remain within the spirit of this disclosure. More particularly, it is of course understood that the serial connection of linear cylindrical sections is known in the art and it is anticipated that other such connections can be employed herewith without departing from the salient aspect of bar member 22, namely that it comprises a plurality of like cylindrical sections which can be axially conjoined for use and can be disjoined for storage and transport. As will appear, bar member 22 may be used alone for stretching exercises and lunges and used coactively with the remaining component members of the present invention to simulate free weight training.

Elastic member 24 is preferably a stretchable and deformable hollow tube which comes in various interchangeable thicknesses to provide various elastic resistances. A plurality of elastic members 24 are thus intended to be interchangeably used with each device 20 to provide a variety of resistance values for adapting to improved muscle strength and for use in different exercises. It is foreseeable that non-hollow or other variably shaped elastic members could be used with alternative embodiments of the present invention, although, a hollow, tubular member 24 is preferred to facilitate the detachable attachment of member 24 to handle means 25 and 26 as will hereinafter be described in greater detail.

Figure 6:
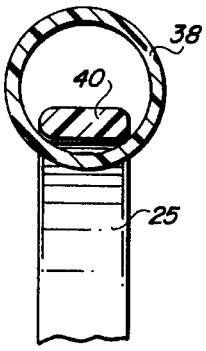
FIG. 6 is a fragmented cross-sectional view of a handle member taken on line 6—6 of FIG. 2.

Handles 25 and 26 are substantially stirrup-shaped as shown in FIGS. 1 and 2. That is, they are preferably generally rectangular with one convex side. Each handle 25, 26 is provided with a rigid hollow cylinder 38, 39, respectively, which are used to connect handles 25, 26 with bar member 22 both for storage and for those exercises requiring a bar member used with the elastic tubing. Cylinders 38 and 39 are loosely attached about the generally flat edge 40 of each handle, for example handle 25 as shown in FIG. 6.

Figure 4:
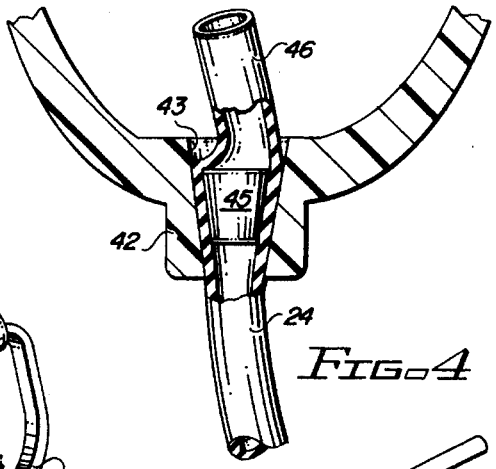
FIG. 4 is a partially fragmented cross-sectional view of one means for attaching the elastic member to a handle member taken on line 4—4 of FIG. 2.
Figure 5:
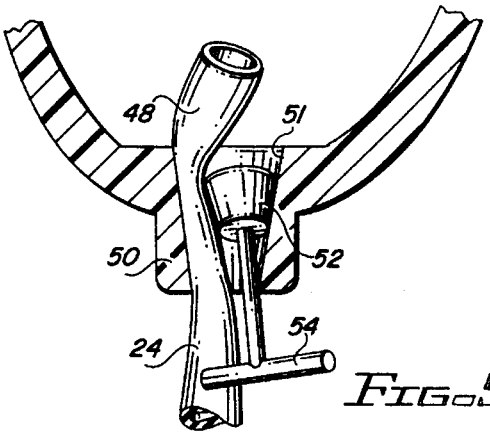
FIG. 5 is a partially fragmented cross-sectional view of adjustable means for attaching an elastic member to a handle member taken on line 5—5 of FIG. 2.

In the convex side of each handle, as shown in FIGS. 4 and 5, is disposed a tubing receptacle such as the receptacle 42 shown in FIG. 4. Receptacle 42 has a frusto-conical opening 43 defined therein. Elastic member 24 is then operably connected to the handle shown in FIG. 4 by having been fed through opening 43. A frusto-conically shaped plug 45, which has previously been press fit into end 46 of elastic tubing member 24, serves as a detent when all of member 24 but the detent containing portion of member 24 is fed through opening 43. Plug 45 thus operably secures member 24 within handle 25 as shown in FIG. 4.

FIG. 5 shows an adjustable means for attaching the second end 48 of elastic tubing member 24 to the second handle 26. Handle 26 has a tubing receptacle 50 having a frusto-conically shaped opening 51 defined therethrough so that receptacle 50 is thus similar in size and shape to receptacle 42 of handle 25. In this case however, a discrete frusto-conical plug member 52 having a T-shaped pull handle 54 attached thereto is disposed in opening 51 and coacts therewith to secure free end 48 of elastic member 24 within handle 26. This arrangement allows for simple adjustment of the length of elastic member 24 as follows. First, end 48 of member 24 is inserted into opening 51 of receptacle 50 and pulled through until the desired length (that is, the free length extending between handle 25 and handle 26) of elastic member 24 is obtained. Then, pull handle 54 is pulled downward which causes plug member 52 to descend in opening 51 and frictionally bear on elastic member 24 and thereby bind it against the inner surface of opening 51 in receptacle 50. The friction of plug member 52 bearing on elastic member 24 and receptacle 50 thus holds elastic member 24 secure during operation of the present invention because all exercises cause a tightening pull on member 24. When the exercise period ends, an upward force on member 24, attained either by pulling upwardly on end 48 of member 24 or by pushing up on handle 54, dislodges plug member 52 and thereby frees elastic member 24 for removal.

Figure 7:
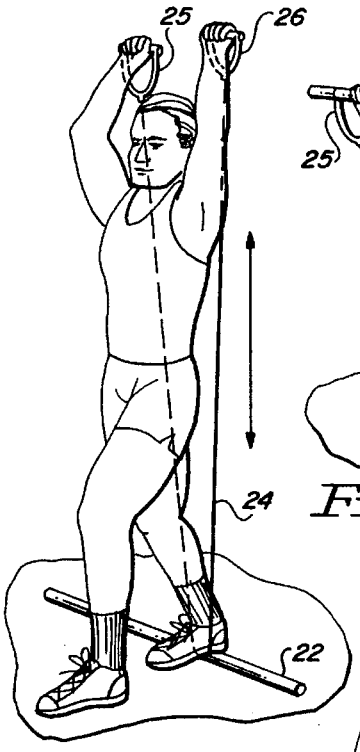
FIG. 7 is an isometric view of the exercising device of FIG. 2 when the bar member is used to anchor the elastic member for use in exercising the triceps in accordance with the present invention.
Figure 8:
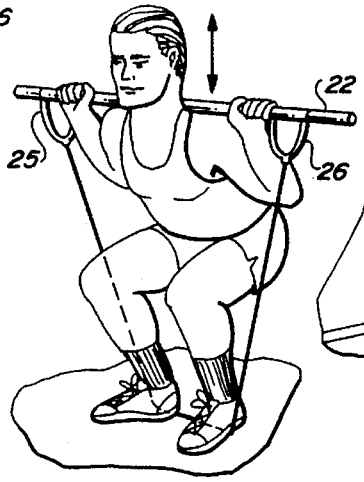
FIG. 8 is an isometric view of the exercising device of FIG. 2 when anchored by the user's feet and in which the bar member is employed as the grip for squat lifts to exercise the thighs and the buttocks.
Figure 9:
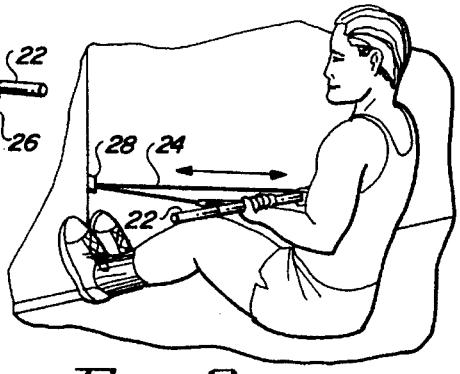
FIG. 9 is an isometric view of the device of FIG. 2 secured to the edge of a door and being utilized to exercise abdominal muscles.
Figure 11:
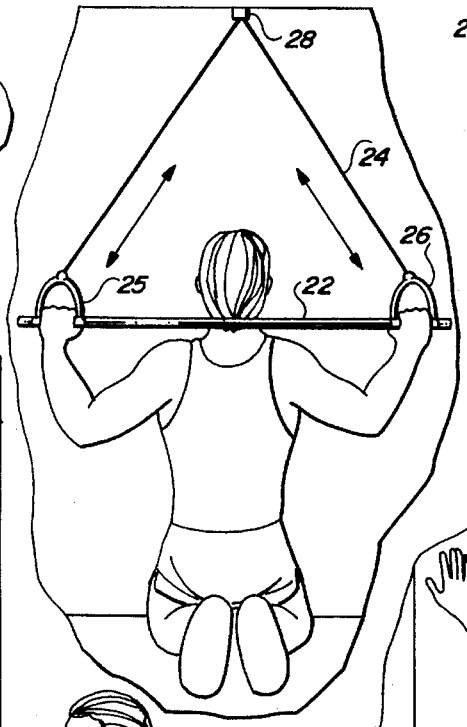
FIG. 11 is an isometric view of the device of FIG. 2 anchored to the upper edge of a door to execute back and lat pull downs for exercising the upper lats.
Figure 10:
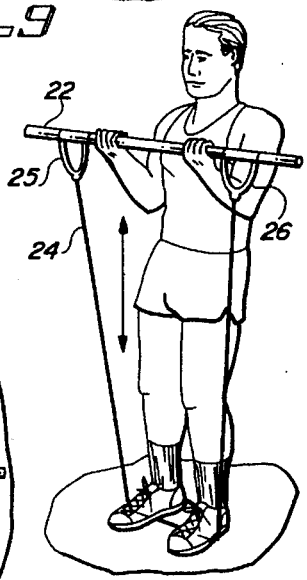
FIG. 10 is an isometric view of the device of FIG. 2 being utilized to execute a standing curl for exercising the biceps.
Figure 12:
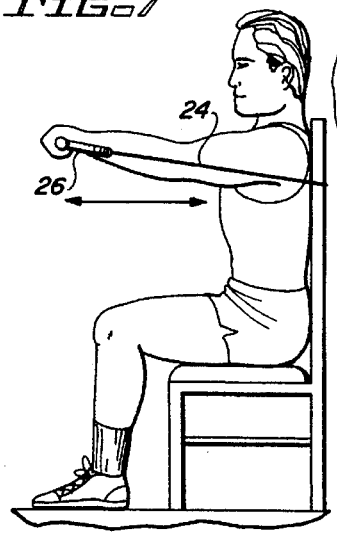
FIG. 12 is an isometric view of the device of FIG. 2 employed with a high backed chair to execute bench presses for exercising pectorals.
Figure 14:
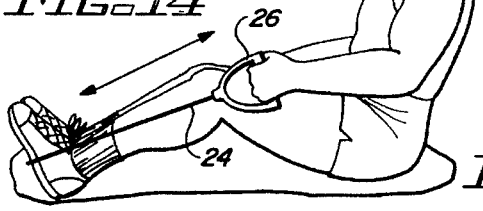
FIG. 14 is an isometric view of the device of FIG. 2 used to execute assisted sit-ups for exercising the abdominal muscles.
Figure 13:
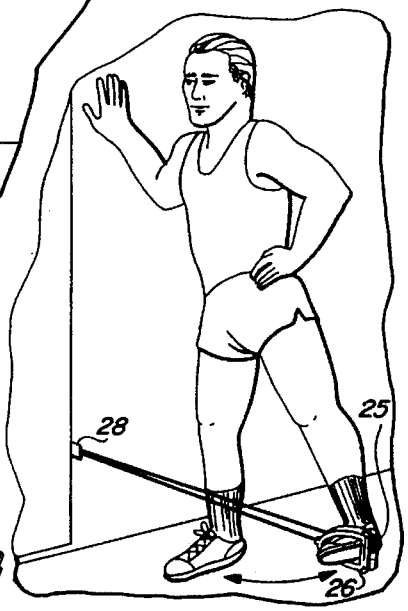
FIG. 13 is an isometric view of the device of FIG. 2 anchored to a door edge to execute hip abduction for exercising the hips and outer thighs.

As will appear, the present invention can be used both with and without bar member 22 in a variety of ways. For example, in some exercises which will be hereafter described and which are shown in FIGS. 7, 13, and 14, the elastic member-handle assembly when used independently of the bar member needs to be anchored in some fashion so that elastic member 24 can be stretched by the user against the elastic resistance necessary for working the muscles. Depending upon the muscle group exercised and the type of exercise performed elastic member 24 may be anchored by the user's feet (as shown in FIGS. 7, 8, 10, and 14) or by a piece of furniture such as a chair (as shown in FIG. 12) or by an auxiliary anchor member 28 (as shown in FIGS. 9, 11 and 13).

Auxiliary anchor member 28, as shown in detail in FIG. 2, comprises a flexible fabric (e.g. nylon) strap sewn together at juncture 58 and is provided with outwardly extending doubled-back flaps 60 and 61 which provide sufficient mass to restrain member 28 between a closed door and a door jamb. In use, elastic member 24 is reeved through the opening in anchor member 28 and rides on plastic shield 62 to reduce wear on elastic member Device 20 is made inexpensively and easily in the preferred embodiment from three base materials. Bar member 22 is preferably made from aluminum or an aluminum alloy or like material which is relatively lightweight and yet highly durable. An optional rubberized or other non-slip grip material or coating can be deployed on bar 22, either along its total length or strategically located at predetermined locations near the ends to enhance one's grip on bar 22. In one preferred practice, sections 31, 32, and 33 of bar 22 will be about 16 inches in length such that when fully assembled, bar 22 will be about 48 inches long.

As mentioned above, elastic member 24 is made from any resilient elastomeric material which provides the desired tensile resistances. As indicated, it is preferable that member 24 be made in a variety of strengths and be of tubular construction to enable the insertion of a plug 45 to facilitate the detachable connection of member 24 to handle 25 as described above.

Handles 25 and 26 are preferably made from a durable molded plastic which is lightweight yet non-deformable when placed under the tensile stresses associated with the physical workouts to be performed with this invention. Certain metals or other materials may also be used with the present invention so long as they are sturdy enough to withstand the forces to be applied to handles 25, 26. Similarly, cylinders 38, 39, frusto-conical plug 45 and plug member 52 are made of sturdy materials preferably plastic, that are strong enough to endure the forces and repetitions intended to be applied thereto in the practice of this invention. Cylinders 38, 39 are preferably loosely attached to the flat, thin portions 40 of handles 25, 26, and may be so attached either during or after the process of molding handles 25, 26 in accordance with known technology.

Further assembly of device 20 requires, as described above, the insertion of a plug 45 into a first end 46 of elastic tubing member 24. Then, member 24 is inserted in and passed through frusto-conical receptacle 42 of handle 25 by inserting second end 48 of elastic member 24 into and through opening 43. Elastic member 24 is then pulled through opening 43 until plug 45 comes to rest in receptacle 42 as shown in FIG. 4. Second end 48 is then inserted into receptacle 50 of handle 26 via the narrower portion of opening 51 as shown in FIG. 5. Elastic member 24 is then reeved through opening 51 until the desired operable workout length of member 24 (between handle 25, 26) is attained. Then, frusto-conical plug member 52 is pulled down into opening 51 by pulling on pull handle 54 until stop member 52 firmly binds elastic member 24 in receptacle 50. Handles 25, 26 with elastic member 24 thus attached may then be used to perform certain exercises as described below without further assembly. However, a greater range of usefulness is obtained when bar 22 and anchor member 28 are additionally employed. Thus, bar 22 may be assembled by simply screwing sections 31 and 33 into opposing ends of section 32 as by inserting the threaded male ends of sections 31 and 33 inside the threaded female sockets of section 32. Again, an example of this process is shown by the insertion of end 35 into socket 36 in FIG. 3. Bar 22 may now be used to perform a variety of additional exercises as described below. Lastly, a still further variety of exercises, also described below, can be performed by the use of anchor member 28 in the manner intended, for instance, second end 48 of elastic member 24 is removed from handle 26, reeved through the opening in anchor 28 and re-inserted into handle 26 and secured therein as before. Anchor 28 is then secured in a doorway between the door and its frame so that first and second flaps 60, 61 are disposed on the obverse side of the door to prevent forceful extrication of anchor 28 and thereby allow further use of the present invention.

Bar member 22 is configured for coactive use with elastic member 24 either by sliding bar member 22 through hollow cylinders 38, 39 on handles 25, 26 to a position dictated by the exercise to be performed as shown in FIGS. 8, 9, 10 and 11, or by wrapping elastic member 24 around bar 22 which, when the exerciser places one or more feet on the bar, as shown in FIG. 7, anchors the system and provides the desired resistance to upward thrust of handle means 25, 26. If desired, an optional coating of non-slip rubberized material may be disposed within hollow cylinders 38, 39 to further secure handles 25, 26 to bar 22 by frictional interaction with an optional, like material disposed on the exterior surface of bar member 22.

Exercises accomplished with a preferred embodiment of the present invention utilizing a bar 22, handles 25, 26 and elastic member 24 include for example: Curls with a standard or reverse grip (standing, See FIG. 10), Tricep Standing Pullovers, Upright and bent over Rows, Front Shoulder Raises, Military Press (front or rear), Bench Press (with chair, See FIG. 12), Shoulder Shrugs, Lower back raises, dead lifts, calves, Squats (See FIG. 8) and exercises for wrists and forearms. In a slightly different configuration of the members of the current invention the bar is located on the floor securing the approximate center of the elastic member while the user grips the handles permitting: Bicep Alternating Curls, Tricep Extensions (see FIG. 7), Lateral Raises, Rear Deltoid Raises, Reverse Flys, Free side bends and other exercises.

Including the use of a door anchor strap 28 still further exercises can be performed. Examples include: Lying curls, Tricep pulldowns, Rear delt pulls, standing incline flys, fly pulldowns, squat curls, Lat pulldowns (front and rear, see e.g. FIG. 11), curl pulls (close grip), close grip pulldowns, Low Rows, straight arm pulls, bent over pulls, hip abductions (see FIG. 13), leg extensions, and a plurality of abdominal exercises including for example, crunches, lower and upper abdominal curls, abdominal pulldowns and assisted sit ups (see e.g. FIG. 9).

Note, several of these exercises may be performed without bar 22. Specific exercises accomplished by use of device 20 without bar 22 and with an anchor member 28 fixed in a door include rear delt pulls, several fly exercises, Low Rows, Abdominal Crunches Down, Abdominal Curls (feet in handles), Rear End Extensions (feet in handles), and Inner and Outer thigh abductions. Exercises accomplished by use of elastic member 24 and handles 25, 26 without either a bar 22 or an anchor member include: Abdominal Leg raises, assisted situps (See FIG. 4) and shrugs.

Several exercises involving standard furniture may be performed such as the bench press (FIG. 12) already mentioned, seated calves, seated flys (without bar 22) and abdominal crunch downs or rotary torso exercises. Further, bar 22 can be used alone for stretching or lunge exercises.

The great utility of device 20 is best recognized by considering the great versatility it provides when all or even a part of its several components are employed in the manner described above.

Thus, with the elastic member 24 properly connected between handle means 25 and 26 and preselected to provide a challenging length and resistance for the user, and bar member 22 fully assembled and deployed, either through cylinders 38, 39 or otherwise used to anchor elastic member 24, a myriad of exercises can be performed to develop, inter alia, the biceps, forearms, triceps, front deltoids, trapezius, outer deltoids, rear deltoids, pectorals, lower back, upper back, upper and lower lats, rhomboids, upper abdominals, lower abdominals, obliques, legs, calves, thighs and buttocks.

In addition, a complete regimen of exercises can be practiced using the elastic member 24 properly connected between handle means 25, 26 and preselected to provide a challenging length and resistance for the user when the elastic member is attached by anchor means 28 to the top or side of a closed door (see FIGS. 9, 11, and 13) and used with or without bar member 22 deployed through cylinders 38, 39 to exercise and develop the biceps, triceps, rear deltoids, upper, lower and inner pectorals, forearms, upper and lower lats, upper back, obliques, upper and lower abdominals, lower back, hips, inner and outer thighs, buttocks and hamstrings.

The foregoing is not intended as a complete listing of the possible exercises and muscle groups to be trained with the present invention. Rather, this is merely an exemplary list that could easily be modified by users skilled in the art of exercise.

Once the exercise period is completed, device 20 may be simply reduced to compact form. First, bar 22 is slidably removed from cylinders 38, 39 of handles 25, 26 (if of course, it hasn't already been so removed during the course of exercising). Bar 22 may then be reduced to its component parts by unscrewing sections 31 and 33 from section 32. Anchor bar member 28 is removed from both the doorway and from elastic member Removal of member 28 from member 24 is accomplished by loosening plug member 52 in handle 26 (see FIG. 5) and removing end 48 from handle 26. Anchor member 28 may then be slid off of member Anchor member 28 is then used to hold all three sections of bar 22 together as shown in FIG. 1. To do so, member 28 is wrapped double about the three sections (as one would wrap a rubber band about a newspaper) and then slid to the center point of length of the three sections. Then, to put device 20 in compact form, end 48 is first re-inserted in handle 26 and one section (either 31, 32, or 33) is inserted into cylinders 38, 39 of handles 25 and 26, one each on opposing sides of anchor member 28. The free working length of elastic member 24 is then wrapped once about the entire assemblage, down under bar sections 31, 32 and 33 and then up and hooked over the tubing receptacles 42, 50 of handles 25, 26 to put device 20 in the shape shown in FIG. 1.

Further, it is readily apparent from the foregoing that a new and useful embodiment of the present invention has been herein described and illustrated which fulfills all of the aforestated objects in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A portable exercise device comprising an elongated elastic member; first and second handle means operatively attached to said elastic member at each end thereof; a first hollow cylinder attached to said first handle means; a second hollow cylinder attached to said second handle means; and bar means insertable through said first and second hollow cylinders for pulling said first and second handle means in unison while stretching said elastic member.

2. A portable exercise device according to claim 1 in which said elongated elastic member is tubular.

3. A portable exercise device according to claim 1 in which each of said first and second handle means has an opening defined therein for passing an end portion of said elastic member therethrough and a locking means disposed in and coacting with said opening and said elastic member to frictionally lock said elastic member to each of said first and second handle means.

4. A portable elastic resistance exercise device according to claim 1 in which said elongated elastic member is interchangeable with other elongated elastic members which differ in length.

5. A portable elastic resistance exercise device according to claim 1 in which said elongated elastic member is interchangeable with other elongated elastic members which differ in length.

6. A portable exercise device according to claim 3 in which one of said locking means comprises a ball-shaped plug having a T-shaped handle extending therefrom through said opening and is actuable in response to force placed on said T-shaped handle to frictionally look said elastic member in said handle means.

7. Portable exercise device according to claim 3 in which said elongated elastic member is tubular and one of said locking means comprises a frusto-conically shaped plug inserted into said tubular elastic member.

8. A portable exercise device according to claim 7 in which the other of said locking means comprises a ball-shaped plug having a T-shaped handle extending therefrom through said opening and is actuable in response to force placed on said T-shaped handle to frictionally lock said elastic member in said handle means.

9. A portable exercise device according to claim 3 in which one of said locking means comprises a frusto-conically shaped plug having a T-shaped handle extending therefrom through said opening and is actuable in response to force placed on said T-shaped handle to frictionally lock said elastic member in said handle means.

10. A portable exercise device according to claim 7 in which the other of said locking means comprises a frusto-conically shaped plug having a T-shaped handle extending therefrom through said opening and is actuable in response to force placed on said T-shaped handle to frictionally lock said elastic member in said handle means.

11. A portable exercise device according to claim 1 which further comprises anchor means for attaching a portion of said elastic member to a fixed point.

12. A portable exercise device comprising an elongated elastic member; first and second handle means operatively attached to said elastic member at each end thereof; an elongated bar member operatively associated with said first and second handle means and said elastic member; each said handle means having an opening defined therein for passing an end portion of said elastic member therethrough and locking means disposed in and coacting with said opening and said elastic member to frictionally lock said elastic member to said handle means; one of said locking means having a plug having a T-shaped handle extending therefrom through said opening, said plug being actuable in response to force placed on said T-shaped handle to frictionally lock said elastic member in said handle means.

13. A portable exercise device according to claim 12 in which said elongated elastic member is tubular and the other of said locking means comprises a frusto-conically shaped plug inserted into said tubular elastic member.

14. A portable exercise device comprising:

a bar member;

an elastic member having first and second ends;

a plug member inserted into said elastic member adjacent said first end thereof;

a first handle having a frusto-conically shaped receptacle defined therein for receiving said elastic member reeved therethrough and for retaining said elastic member disposed therewithin by coaction with said plug member;

a second handle having a frusto-conically shaped receptacle defined therein for receiving said elastic member reeved therethrough and for retaining said elastic member disposed therewithin;

an adjustable stop member disposed in said frusto-conically shaped receptacle defined in said second handle, said adjustable stop member having a pull member attached thereto, said adjustable stop member being coactive with said frusto-conically shaped receptacle of said second handle to bear against and secure said elastic member within said frusto-conically shaped receptacle of said second handle, said pull member being used to operably force said stop member against said elastic member within said frusto-conically shaped receptacle of said second handle;

a first hollow cylinder attached to said first handle for operably receiving one portion of said bar member therewithin; and a second hollow cylinder attached to said second handle for operably receiving another portion of said bar member therewithin.

15. A portable exercise device according to claim 14 further comprising an anchor member operatively associated with said elastic member and having an enlarged detent for insertion within a closed doorway to secure said elastic member relative thereto in response to pressure placed thereupon.

16. A device according to claim 14 in which said adjustable stop member is frusto-conically shaped.

17. A device according to claim 14 in which said bar member comprises three separate portions.

18. A portable exercise device according to claim 12 in which said plug is ball shaped.

19. A portable exercise device according to claim 12 in which said plug is frusto-conically shaped.

* * * * *